US005358378A

United States Patent [19]

Holscher

[11] Patent Number: 5,358,378

[45] Date of Patent: Oct. 25, 1994

[54] MULTISTAGE CENTRIFUGAL COMPRESSOR WITHOUT SEALS AND WITH AXIAL THRUST BALANCE

[76] Inventor: Donald J. Holscher, 7935 W. 81st St., Playa del Rey, Calif. 90293

[21] Appl. No.: 977,777

[22] Filed: Nov. 17, 1992

[51] Int. Cl.[5] ..... F01D 5/14

[52] U.S. Cl. ..... 415/170.1; 415/104

[58] Field of Search ..... 415/170.1, 172.1, 174.4, 415/177, 198.1, 104, 106, 107

[56] References Cited

U.S. PATENT DOCUMENTS

| | | | |
|---|---|---|---|
| Re. 12,584 | 12/1906 | Lea et al. | 415/106 |
| 1,238,731 | 9/1917 | Anderson | 415/106 |
| 3,874,812 | 4/1975 | Hanagarth | 415/106 |
| 4,655,681 | 4/1987 | Mori et al. | 415/100 |
| 4,802,826 | 2/1989 | Hall | 417/243 |
| 4,820,115 | 4/1989 | Bandukwalla | 415/106 |
| 4,867,633 | 9/1989 | Gravelle | 415/106 |
| 4,909,705 | 3/1990 | Katsura et al. | 415/199.1 |
| 4,927,327 | 5/1990 | Keller | 415/172.1 |
| 4,969,803 | 11/1990 | Turanskyj | 415/177 |

FOREIGN PATENT DOCUMENTS

| | | | |
|---|---|---|---|
| 390366 | 10/1921 | Fed. Rep. of Germany | 415/106 |
| 809758 | 7/1949 | Fed. Rep. of Germany | 415/106 |
| 384675 | 4/1908 | France | 415/106 |

*Primary Examiner*—John T. Kwon

[57] ABSTRACT

A modular multistage centrifugal compressor with plural rotors on a common drive shaft driven by a high speed drive. A throttled leakage path between adjacent stages of the compressor reduces the axial loading on the rotors, which have axial freedom on the common drive shaft, to essentially zero. This same throttled leakage path flows between stages in the area around the common drive shaft, eliminating the need for interstage shaft seals. The compressor accommodates a family of drive sources including motors, diesel and gas engines, CNG engines and direct drive turbines.

1 Claim, 4 Drawing Sheets

MULTISTAGE CENTRIFUGAL COMPRESSOR WITHOUT SEALS AND WITH AXIAL THRUST BALANCE

BACKGROUND-FIELD OF INVENTION

This invention is a simplified concept for a long-life inexpensive multistage centrifugal compressor which does not require shaft seals and has automatic rotor axial thrust balance.

BACKGROUND-DESCRIPTION OF PRIOR ART

Their is an increasing demand for low cost/long life compressors that can compress gasses to high pressures (e.g., 4000 psi.). An example of this occurs in the current campaign to use compressed natural gas (CNG) as an alternate fuel for vehicles. CNG must be supplied to the vehicle's on-board tank at pressures of 3600 to 4500 psi. Because of the high cost and poor reliability of current reciprocating compressors with this capability, this area has been identified as a "weak link" in the CNG alternate fuel program.

It is generally agreed that centrifugal compressors inherently have a longer life than reciprocating compressors, however, bearings and shaft seals are two critical areas impacting the life of high pressure centrifugal compressors. Bearing life is very sensitive to axial load. Unfortunately, high pressure centrifugal compressors are notorious for high axial shaft loads which can exceed 10,000 lbs. Bearing life is unacceptable at these levels of axial load. In the compressor concept of this invention, axial shaft loads are essentially reduced to zero by a feedback leakage path between stages which balances the axial rotor forces. This feedback leakage flows to the intake chamber of the prior (lower pressure) compressor stage in the area between the shaft and the compressor case (the area where the interstage shaft seal would normally be located), hence, the need for shaft seals (the second critical area impacting life described above) is eliminated.

Review of prior art applicable to my compressor found no prior art which allowed the elimination of interstage shaft seals in a multistage centrifugal compressor. In addition, no prior art was found that described my compressor concept of using a closed loop throttling of a leakage path to the intake chamber of the prior compressor stage which reduces to zero axial shaft loads due to rotor axial forces while maintaining high compressor performance efficiency.

The closest prior art found was U.S. Pat. No. 3,874,812 to Hanagarth (1975) which describes an axial pressure balancing concept for a two stage water pump.

Hangarath's patent describes a throttled leakage path from the back of the rotor to the inlet of the same stage for balancing axial thrust forces on the rotor. This concept has several serious disadvantages compared to the concepts of my compressor:

(1) A throttled leakage path from the back of the rotor to the inlet of the same stage does not allow the elimination of interstage shaft seals.

(2) A leakage path from the back of the rotor to the input (front of rotor) has serious implementation problems. Hanagarth's proposed embodiment of drilling axial ducts through the base of the rotor weakens the rotor in the area of highest centrifugal stress and has been known to cause rotor stress failure. The alternate concept of completing the leakage path through an axial passage in the rotor shaft is extremely complex and expensive.

(3) Significantly higher leakage flow is required in the cited patent concept to achieve the same force balance on the rotor which reduces compressor efficiency. In my compressor concept, leakage flows to the inlet chamber of the prior stage (a point of much lower pressure) which allows the establishment of a lower pressure field (for rotor axial force balance) with lower flow rates and, hence, higher compressor efficiency.

Hanagarth's embodiment also includes a second leakage path from the back of the rotor to "the inlet of the next following rotor". This leakage path from the inlet of the following stage (a high pressure point) allows high pressure flow into the gap behind the rotor. Although this leakage concept is used in some water pumps and some low performance gas compressors (e.g., low pressure turbochargers) as a crutch to improve stability, it results in major performance degredation in high performance gas compressors for two reasons:

(1) The leakage path is a recirculating load on the compressor which significantly reduces efficiency, and (2) The high pressure leakage flow to the gap behind the rotor increases the axial load on the rotor making axial pressure balance much more difficult (if not impossible) requiring very large throttled leakage flow with accompanying efficiency loss. Hanagarth's patent describes his preferred embodiment of the high pressure leakage path is "each duct 7 is located in the respective stator portion 21 adjacent the stator sleeve 31". It is important to note that nowhere in his patent did Hanagarth describe or refer to a leakage path concept between the stator and shaft which would eliminate the need for inter stage shaft seals. It is also important to note that Hanagarth used conventional shaft seals in his embodiment.

In summary, Hanagarth's patent does not in anyway address the most significant feature and advantage of my compressor concept—an embodiment which automatically balances rotor axial thrust which embodiment eliminates the need for compressor shaft seals while maintaining high compressor efficiency (even at the very high gas pressures encountered in the referenced CNG compressor application).

OBJECTS AND ADVANTAGES

Accordingly, besides the objects and advantages of the multistage centrifugal compressor described in my above patent, several objects and advantages of the present invention are:

(a) to provide a centrifugal compressor with an operating life previously unachievable with a unique design that addresses the two most critical components impacting life (bearings and shaft seals).

(b) to provide a centrifugal compressor with a modular design of minimum axial extent that allows adding additional stages as required.

(c) to provide a centrifugal compressor with a large stable operating region (no surge) to allow more flexible system operation.

(d) to provide a centrifugal compressor which will accommodate a large family of drive sources (electric motors,diesel and gas engines, CNG engines, turbines, etc.).

Further objects and advantages of my invention will become apparent from a consideration of the drawings and ensuing description.

DRAWING FIGURES

DESCRIPTION—FIGS. 1, 2 & 4

Figure 1:
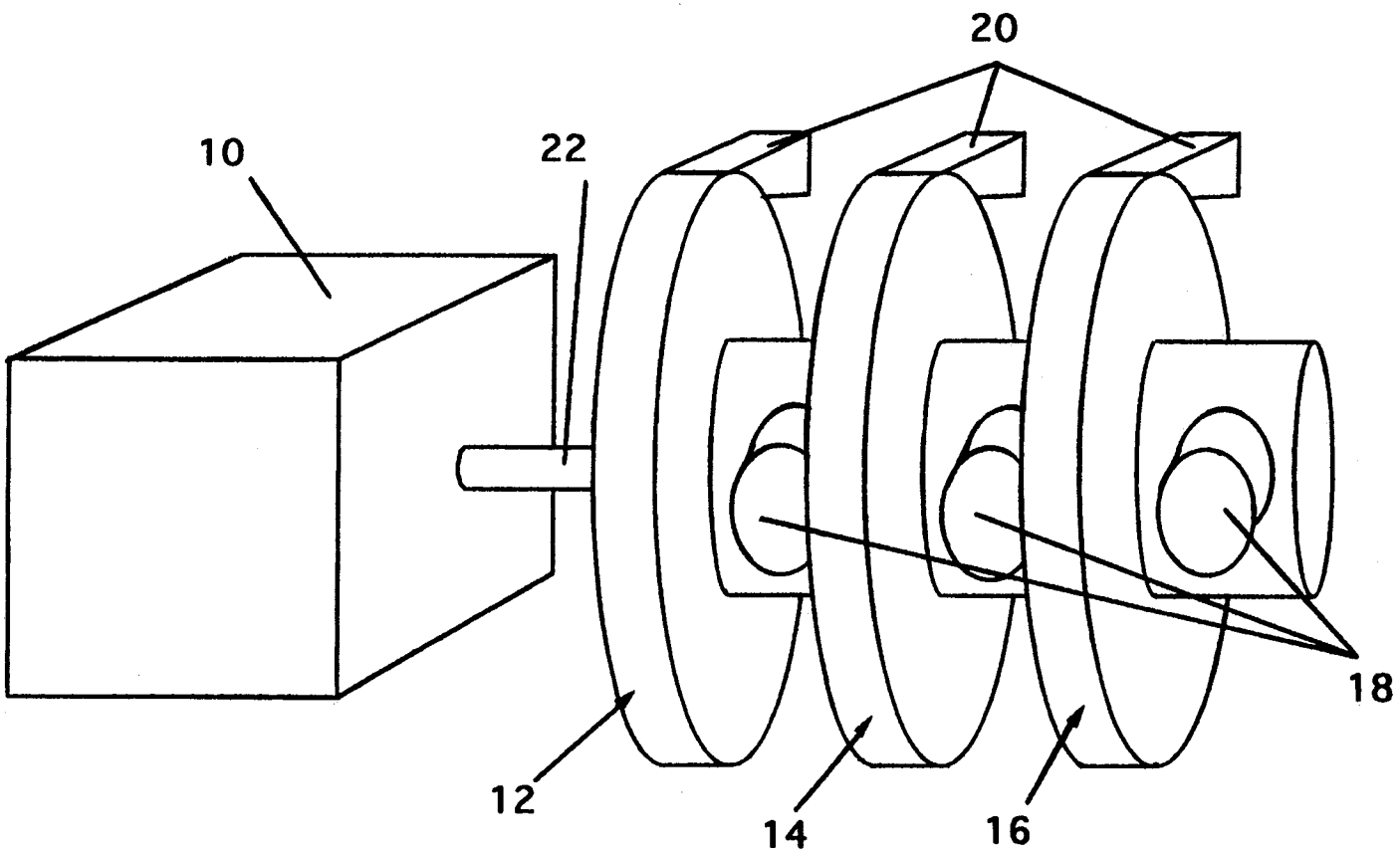
FIG. 1 is a perspective view of the multistage centrifugal compressor with a drive system.

FIG. 1 shows an embodiment of the multistage centrifugal compressor. Although the patent claims apply to all types of centrifugal compressors, the embodiment illustrated is a partial emission type centrifugal compressor. Three units (stages) of compression are shown; unit one 12, unit two 14, unit three 16. A compressor drive shaft 22 is driven by a high speed drive system 10 (normally at speeds in excess of 20,000 rpm.). Each unit of the compressor has a input 18 and a output 20 (some designs will have multiple outputs but only one is shown here for simplicity).

High speed drive system 10 normally consists of a motor driving a high speed gear box, however , several options are possible including direct drive turbine systems.

Figure 2:
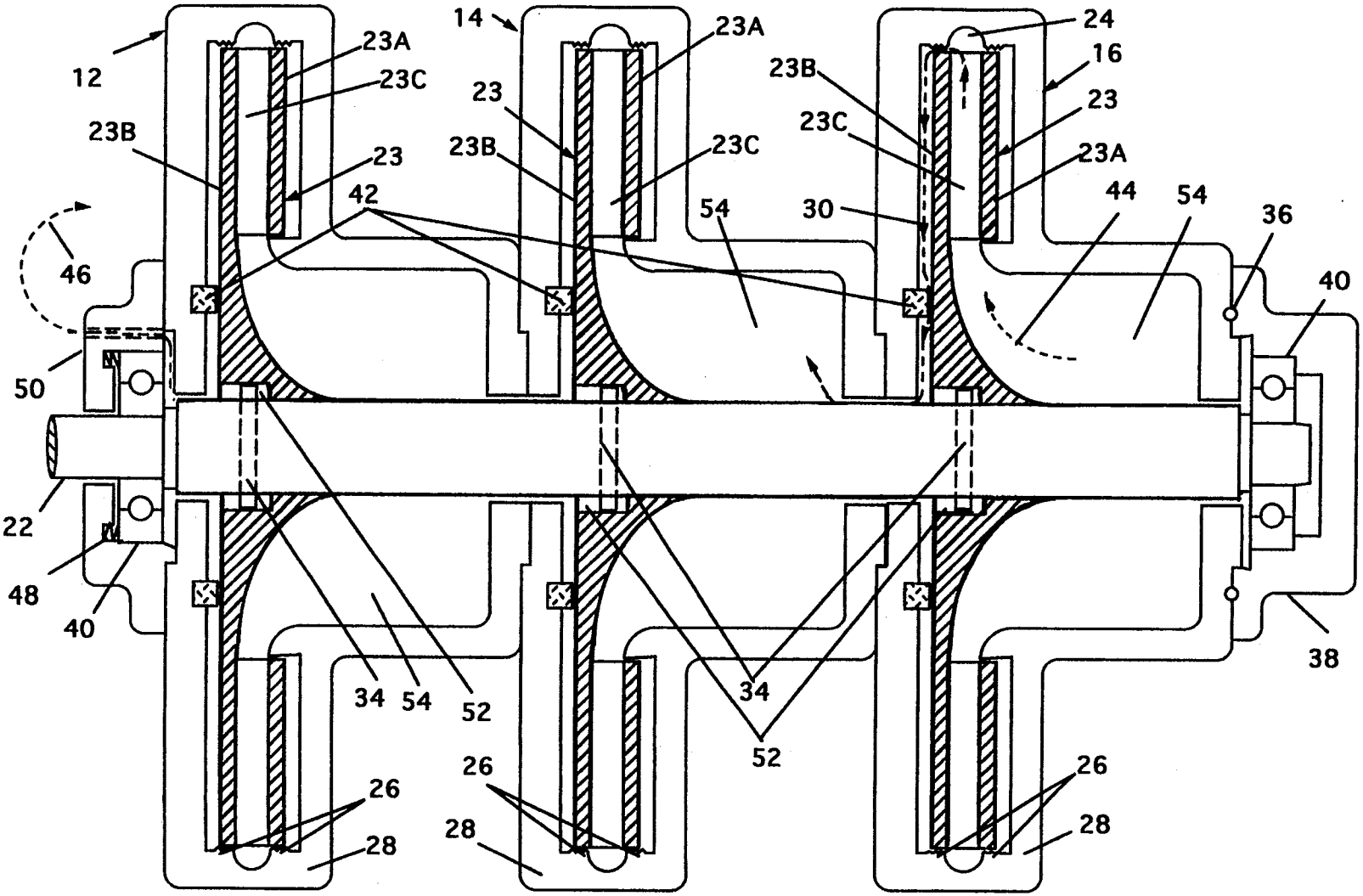
FIG. 2 is a cross section view of the multistage compressor showing the components of the compressor and the control leakage paths.

FIG. 2 shows a cross section view of the three unit (stage) compressor shown in FIG. 1. Each unit (stage) has an identical casing 28 which is modular in design allowing the easy addition of additional stages. For simplicity, bolts and other structure used to hold the compressor together are not shown.

In FIG. 2, a rotor assembly for each unit is attached to common drive shaft 22. Each rotor consists of a front face 23A (which is disk shaped with a center hole for fluid entry 44) plus a rear face 23B which is also disk shaped but increases in width at the center to provide rigidity in the area of attachment to drive shaft 22. Sandwiched between front and rear faces of the rotor are rotor blades 23C positioned in a radial pattern about drive shaft 22. Fluid 44 entering the rotor 23 is accelerated by blades 23C and exits the case through a channel 24 to output 20 shown in FIG. 1. In FIG. 2, leakage of fluid out of channel 24 is attenuated by a radial non-contact seal 26 in case 28. These non-contact seals 26 radially face the ends of each rotor's front face 23A and rear face 23B and are typically labyrinth type seals. Leakage 30 out of channel 24 flowing down the rear face of the rotor (the radial gap between rear face 23B and case 28) is further attenuated by a throttling ring 42 before flowing into the intake chamber 54 of the prior unit.

Rotor assembly is free to move axially on drive shaft 22. This is achieved by attaching rotor assembly 23 to drive shaft 22 with a rotor pin 34 which moves in a rotor pin slot 52 at the base of rotor rear face 23B. This axial motion of rotor assembly 23 modulates leakage path 30.

Compressor shaft 22 is supported at each end of the compressor by a bearing 40. Bearing 40 at the right end of the compressor is attached to compressor case 28 by a hermetic bearing retainer 38 using a O-ring seal 36. This right end of the compressor is unit three 16, the high pressure stage. At the left end of the compressor, bearing 40 is attached to compressor case 28 with a bearing retainer 50. Internal to bearing retainer 50, a bearing preload spring 48 supplies the proper axial preload to both bearings 40.

Figure 3:
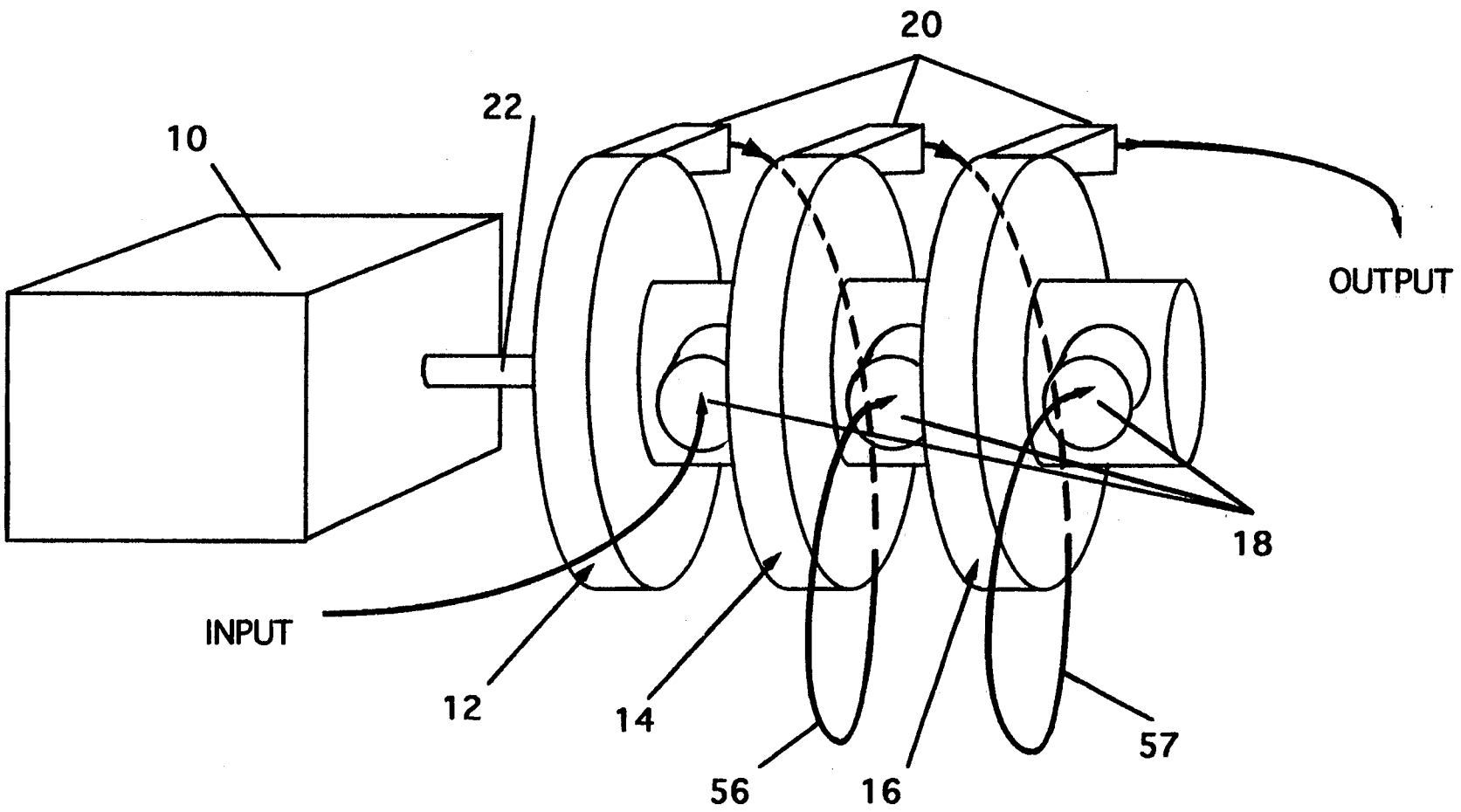
FIG. 3 shows the interstage flow paths for a multistage centrifugal compressor.
Figure 4C:
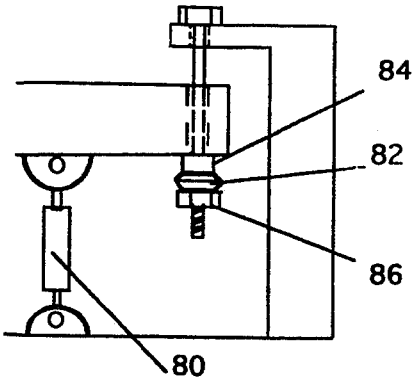
FIG. 4C shows an expanded view of the spring mechanism for idler force control.
Figure 4B:
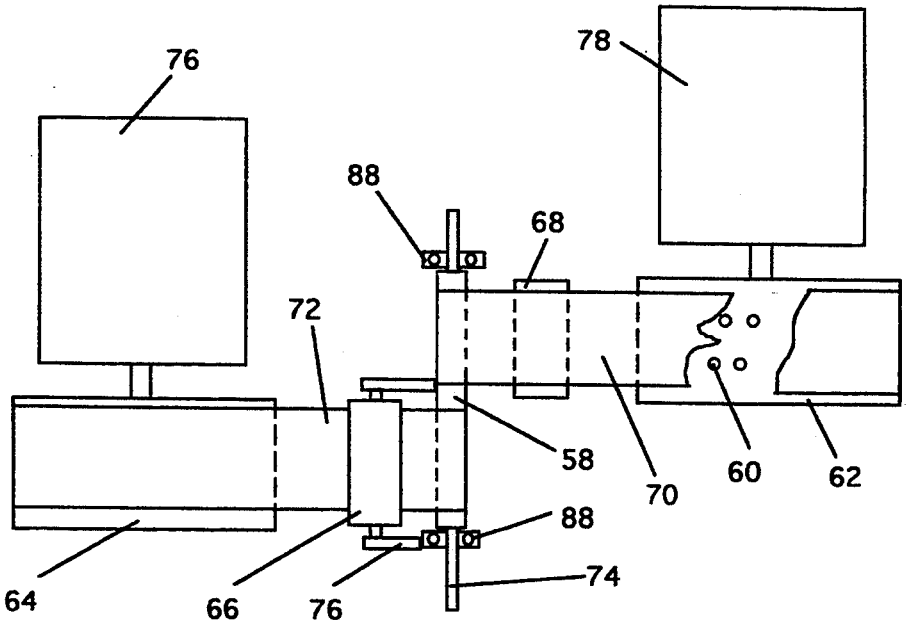
FIG. 4B shows a top view of a high speed belt drive system.
Figure 4A:
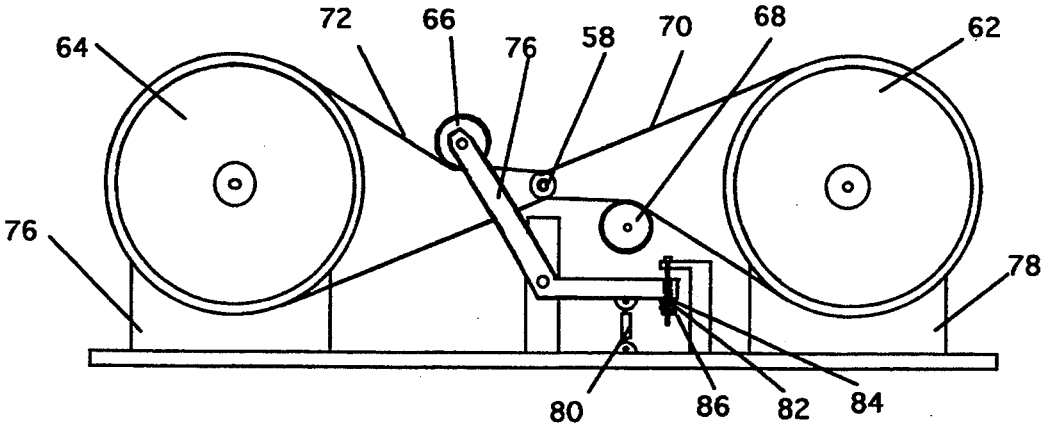
FIG. 4A shows a front view of a high speed belt drive system.

FIG. 4 shows two views of a high speed belt drive system which could be used for the high speed compressor drive system 10 in FIGS. 1 & 3. Two drive sources are shown in FIG. 4 (a left drive motor 76 and a right drive motor 78), however, the basic belt drive concept will accommodate multiple drives. The two sides of the belt drive system are essentially symmetrical, hence, detailed implementation is only shown for the left side for simplicity. Drive motor 76 drives a drive pulley 64 which in turn drives a common driven pulley 58 by means of a belt 72. Constant tension is maintained in belt 72 by a guide roll 66 (sometimes referred to as an idler). Position of guide roll 66 is controlled by a arm 76. The position (and, hence, force) on arm 76 in turn is controlled by a disk spring 82 (see FIG. 4C) which is an expanded view). Only one pair of disk springs (sometimes called belleville springs) is shown for simplicity, but normally multiple springs would be used to achieve essentially a constant spring force independent of displacement. Force on disk spring 82 is controlled by a control nut 86 and this force is measured by a force transducer 84. Normally this force is adjusted to mid rage in the disk spring 82 constant force versus displacement characteristic. Force on arm 76 and hence on guide roll 66 is also generated by a damper 80 which generates a force proportional to displacement rate. Operation of the right side of the belt drive is identical to that just described for the left side where drive motor 78 drives a drive pulley 62 which in turn drives common driven pulley 58 by means of a belt 70. Constant tension is maintained in belt 70 by a guide roll 68.

Common driven pulley 58 is supported at each of its ends by a bearing 88. To achieve a output shaft 74 speed of the order of 30,000 rpm., linear belt 70,72 speeds approach 200 mph. At these speeds, aerodynamic effects are quite important and belts tend to float on pulleys. To prevent this phenomena, a pattern of aerodynamic vent holes 60 are drilled on the face of both drive pulleys 62, 64.

OPERATION—FIGS. 1 TO 3

The compression process for the multistage centrifugal compressor shown in FIG. 3 is initiated by starting the drive motor in the high speed drive system 10. As the compressor drive shaft 22 comes up to speed, fluid compression begins. The fluid is supplied to input 18 in unit one 12 (labeled INPUT in FIG. 3). After compression, the fluid is routed from the output 20 of unit one 12 to the input 18 of unit two 14 as shown by the interstage flow path 56. Normally this interstage flow passes through an intercooler. In like fashion, after compression in unit two 14, the fluid is routed to the input 18 of unit three 16 as shown by the interstage flow path 57. Finally, after compression in unit three 16, the fluid is supplied at the desired output pressure through output 20 then through a tube (labeled OUTPUT in FIG. 3) for delivery external to the compressor.

A more detailed understanding of compressor operation can be obtained from FIG. 2. Compressor unit three 16 is on the right side of this figure. Fluid input 44 to this stage enters the rotor 23 from the intake chamber 54 and is accelerated and compressed by rotor blades 23C. The fluid then discharges at the radial periphery of the rotor 23 and exits the compressor case through channel 24 to output 20 (shown in FIG. 3). Although high pressure leakage out of channel 24 is attenuated by radial non-contact seal 26, high pressure fields do leak into the area between the rotor front face 23A and the case 28 and also between the rotor rear face 23B and the case 28. These high pressure fields operate on the rotor external area. Since the area of the rear rotor face 23B is much larger than the front face 23A, the rotor 23 experiences a very large axial force to the right which would normally destroy the compressor shaft bearings 40. In the patent concept, however, rotor assembly 23 is free to move axially on drive shaft 22 and hence will move to the right (toward the intake chamber 54) due to the large axial force. This motion opens the gap between the throttling ring 42 and the rear face of the rotor 23B which opens leakage path 30 to the very low pressure of the intake chamber 54 of unit two 14. The rotor assembly 23 will continue moving to the right (opening the throttle gap) until the axial forces are balanced (due to the introduction of the low pressure field on the rear face 23B). This closed loop throttling system continually updates the rotor 23 axial position to maintain zero axial forces.

Leakage path 30 flows into the intake chamber 54 of the prior stage through the coaxial gap between the compressor drive shaft 22 and the compressor case 28. This is the area where the compressor interstage seal would normally be required. Because the flow rate through this gap has been reduced to a negligible amount by the closed loop throttling system described above, no seal is required.

Axial force balance for the rotor assembly 23 for unit two 14 is identical to that described above for unit three 16. Axial force balance for unit one 12 is also identical with one exception. Since there is no "prior stage" for unit one, leakage path 30 is terminated back to the input of unit one (as shown by leakage path 46). Generally , axial balance is less critical in unit one since pressure fields are very low.

SUMMARY, RAMIFICATIONS AND SCOPE

Accordingly, the reader will see that the multistage centrifugal compressor of this invention is a unique concept providing an operating life and a low cost previously unachievable. The unique compressor design addresses the two most critical components impacting life (bearings and shaft seals). The unique interstage throttled leakage path eliminates the need for shaft seals and also reduces bearing axial loads to essentially zero to achieve long life. Furthermore, the compressor is a modular design with a reduced number of piece parts to achieve not only a low cost but also a modular flexibility to add additional stages as required. Finally, the compressor will accommodate a large family of drive sources (electric motors, diesel and gas engines, CNG engines, direct drive turbines, etc.).

While my above description contains many specificities, these should not be construed as limitations on the scope of the invention, but rather as an exemplification of one preferred embodiment thereof. Many other variations are possible. For example, FIG. 3 shows a horizontal embodiment of the compressor and high speed drive system. Vertical embodiments are obviously also possible along with 90 degree embodiments where, for example, the drive system could be horizontal and the compressor vertical (perhaps underground). Accordingly, the scope of the invention should be determined not by embodiment(s) illustrated, but by the appended claims and their legal equivalents.

I claim:

1. A high efficiency radial flow type centrifugal compressor comprising:

a. at least two compressor units mounted together with a common shaft, b. a means for supporting said shaft on both ends at the outside of said compressor unit, c. a leakage path defined by between said compressor units and said shaft, d. each of said compressor units has an intake chamber prior to a rotor assembly and an outlet at the radial periphery of said rotor assembly, e. said rotor assembly mounted on said shaft axially movably, f. a means for limiting the axial movement of said rotor assembly at a base of said rotor assembly, g. a throttle ring provided between a rear face of said rotor assembly and a compressor casing for regulating leakage before flowing into said intake chamber of said proceeding compressor unit, h. wherein said leakage entering to said intake chambers of said proceeding compressor unit through said leakage path balances the axial force on said rotor assembly.

* * * * *